United States Patent [19]

Peppler et al.

[11] Patent Number: 4,611,747

[45] Date of Patent: Sep. 16, 1986

[54] METHOD FOR PRODUCING CONTINUOUS LENGTH HIGH SOLIDS ENAMEL COATED MAGNET WIRE

[75] Inventors: Dennis L. Peppler; Mohammad F. Zaman, both of Fort Wayne, Ind.; Norman S. Bornstein, West Hartford; Marvin E. Hartz, Glastonbury, both of Conn.

[73] Assignee: Essex Group, Inc., Fort Wayne, Ind.

[21] Appl. No.: 734,625

[22] Filed: May 15, 1985

[51] Int. Cl.[4] ..... H01B 13/06

[52] U.S. Cl. ..... 228/125; 29/460; 228/176

[58] Field of Search ..... 228/156, 176, 125; 219/85 CA, 85 CM; 29/460

[56] References Cited

U.S. PATENT DOCUMENTS

| | | | |
|---|---|---|---|
| 310,258 | 1/1885 | Cowles | 228/156 X |
| 1,561,224 | 11/1925 | Fritsche | 219/85 CA X |
| 3,857,013 | 12/1974 | Niesse | 219/85 CA |

OTHER PUBLICATIONS

*Nonferrous Wire Handbook,* vol. 2; 1981; (Chapter 10-"-Silver Brazing Techniques"), pp. 133-138.

*Primary Examiner*—Kenneth J. Ramsey
*Attorney, Agent, or Firm*—A. Dean Olson

[57] ABSTRACT

A high speed method of producing continuous length magnet wire coated with a high solids content polymer coating composition. Copper or copper alloy wire segments are joined by brazing utilizing a braze whose melting point is greater than 1000° F. and less than 1600° F. The thus formed joint has a tensile strength greater than 27,000 p.s.i., and is capable of being conformed to the circumference of the wire substrate without substantially altering the surface integrity of the wire. The continuous length magnet wire is preheated to an elevated temperature. The preheated wire is coated with a noncirculating polymer enamel composition having a high solids content and a high viscosity at high speed. The enamel coated wire is then cured.

1 Claim, 2 Drawing Figures

FIG. 1
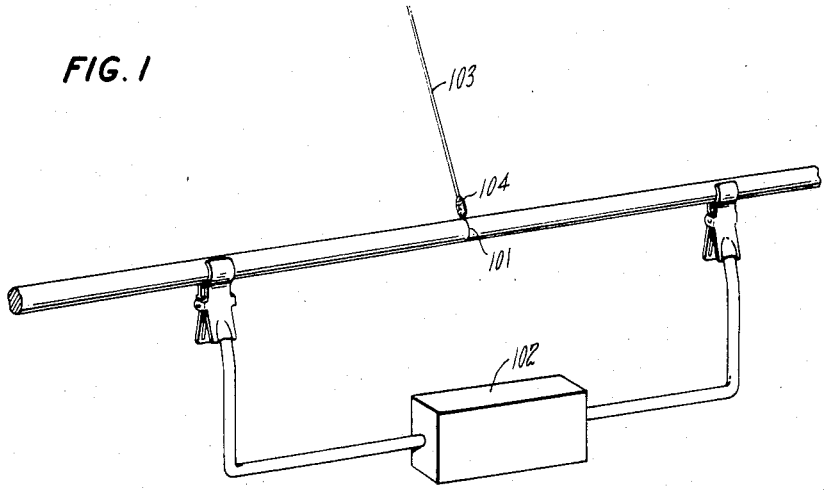
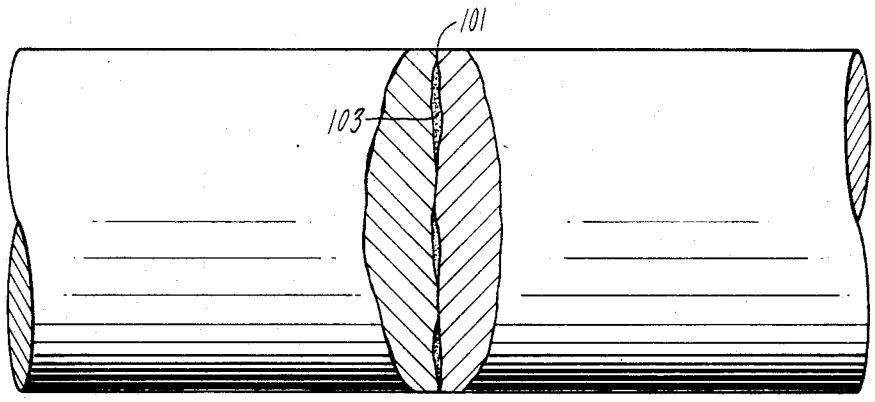
FIG. 2

METHOD FOR PRODUCING CONTINUOUS LENGTH HIGH SOLIDS ENAMEL COATED MAGNET WIRE

CROSS REFERENCE TO RELATED APPLICATION

Attention is directed to commonly assigned copending application Ser. No. 659,734 entitled "High Solids Magnet Wire Enamel Application Method" the disclosure of which is hereby incorporated by reference.

TECHNICAL FIELD

The field of art to which this invention pertains is coating methods, and specifically methods of applying polymer insulation to continuous lengths of magnet wire substrates.

BACKGROUND ART

There has been a trend in the coating art in general to attempt to prepare coating compositions in higher and higher solids content. In addition to utilizing a lesser amount of solvent to prepare the coating compositions, less energy is required to drive off the solvent after the compositions are applied. However, the use of higher solids compositions can cause countless problems both in the precoating handling of the material and the actual application of the coating material. Furthermore, the coating of continuous length wire compounds the above problems by introducing difficulties relating to the joining of wire segments. In the case of magnet wire the production of suitable coatings is even more difficult, because of the stringent requirements for the electrical insulation performance of such wire.

Accordingly, what is needed in this art is a coating method particularly adapted to coating continuous length magnet wire which overcome such problems.

Disclosure of Invention

The present invention is directed to a high speed method of producing continuous length magnet wire coated with a high solids content polymer coating composition. In this process, a plurality of copper or copper alloy wire segments are joined by brazing an end of one wire substrate segment to an end of a second wire substrate segment utilizing a braze whose melting point is greater than about 1000 degrees Fahrenheit (°F) and less than about 1600° F. The thus formed joint has a tensile strength greater than 27,000 pounds per square inch (p.s.i.), and is capable of being conformed to the circumference of the wire substrate without substantially altering the surface integrity of the wire. The continuous length of wire substrate is preheated, controlling the temperature of the wire substrate to an elevated temperature. A noncirculating polymer enamel composition having a high solids content and a high viscosity is applied to the wire through a wire centering coating die at high speed. The enamel coated wire is then cured.

This discovery provides a significant advance to continuous wire enamel application processes. This process enables the production of continuous length coated magnet wire because there are no hangups or stoppages as the wire passes through the coating die.

The foregoing and other features and advantages of the present invention will become more apparent from the following description and accompanying drawings.

BRIEF DESCRIPTION OF DRAWINGS

FIG. 1 shows a perspective view of the brazing process of the present invention.

FIG. 2 shows an enlarged view of a portion of the brazed joint partly broken away and partly in section.

BEST MODE FOR CARRYING OUT THE INVENTION

The wires coated according to the present invention are conventional magnet wire substrates such as are disclosed in commonly assigned copending application Ser. No. 659,734. It is preferred that the wire substrate comprises copper or its alloys. Copper alloys refers to alloys comprising at least 50 percent by weight (%) copper. It is especially preferred that copper wire is used in the practice of this invention. Typical wire sizes range anywhere from 4 AWG (American Wire Gage) to 28 AWG in diameter with 18 AWG being the most commonly coated wire. Wire coatings typically range from 0.8 mil to 5.0 mils but any thickness that can be applied in one or more passes may be envisioned in the practice of this invention. Preferably, a 3.2 mil coating on 18 AWG wire is applied in approximately 3–6 passes with curing between coats.

The coatings can be used as a sole insulation coat or part of a multicoat system in combination with other conventional polymer insulation. Typically, THEIC polyester base coats are applied (Note commonly assigned U.S. Pat. No. 4,476,279, the disclosure of which is incorporated by reference) with polyamideimide or polyamide overcoats. Other polymers useful with the present invention include polyester, polyamideimide, polyamide, polyurethane and polyvinylformal. The base coat to topcoat ratios of the total enamel build range is from 70–90:30–10. The polymer coating of the present invention can also contain lubricants either externally on the coating, internally in the coating, or both. A typical (external) lubricant comprises equal amounts of paraffin wax, bee's wax and vaseline and roughly equal amounts applied out of conventional enamel solvents. As stated above, the solids content of the polymer should be high, prefereably greater than 30%. Some of the polymers (e.g. polyester base coats) can be applied at solids contents greater than 60%. The viscosity should also be high, preferable greater than 60,000 centipoise (CPS) at 86° F., and can be greater than 90,000 CPS at 86° F. even to the point of being friable solids.

Any braze (brazement, solder, alloy) filler material may be used in the practice of this invention that results in a joint tensile strength greater than 27,000 p.s.i. and in a joint that is easily conformable to the circumference of the wire without substantially altering the surface integrity of the wire. It is preferred that the braze filler material have a melting point between about 1000° F. to about 1600° F., preferably about 1100° F. to about 1200° F. If the braze used has a melting point outside of this temperature range, several problems occur. First, if a low temperature braze is used, the joint will soften, deform, or even break as it passes through the enamel curing ovens which have a temperature of typically about 900° F. If the melting point of the braze used is greater than about 1600° F., the elevated temperatures required for the braze result in an increased rate of chemical oxidation such that the resulting joint is weakened. In addition, as the melting point of the braze approaches the melting point of the wire substrate utilized, e.g. copper wire melting point 1980° F., the brazing process will soften and eventually melt the copper wire causing a deformation in the shape. Any deformation in the wire shape causes significant problems, e.g. as described below, during the enamel coating process. It is especially preferred that a braze comprising about 10% to about 70% silver, preferably about 15% to about 25% silver is used as the lower silver content provides a braze with a low flow temperature resulting in good surface coverage of the joint while maintaining good strength. Flow temperature refers to the temperature at which the braze flows in comparison to the melting point temperature where a droplet forms. It is especially preferred that about 15% is used in the practice of this invention. This silver braze may be alloyed with other metals such as copper, tin and phosphorous. A typical silver braze which may be used is Sil-Fos TM (Handy and Harmon, N.Y., N.Y.) having about 15% silver, 80% copper and 5% phosphorous.

Any flux compatible with the above-described filler material and wires may be used in the practice of this invention. The flux should be capable of both cleaning the surface, especially of oxides, and facilitating wetting of the solder. Conventional fluxes such as acid or resin fluxes are suitable. Handy flux TM (Handy and Harmon, N.Y., N.Y.) is an exemplary material containing flouride compounds (e.g. sodium, potassium, lithium, etc.).

The process of this invention comprises brazing the ends of two wire segments together, preheating the wire substrate, applying the high solids content enamel to the wire, and curing the enamel. Much of the polymer application of this process is described in commonly assigned copending application Ser. No. 659,734, however, pertinent parts of the process are further detailed below.

Any brazing process that results in a joint having a tensile strength greater than 27,000 p.s.i. and a joint that is capable of being conformed to the circumference of the wire substrate without substantially altering the surface integrity of the wire may be used in the practice of this invention. It is preferable to braze the wire segments together by using resistance heat, however, radiant energy (induction heat) will also work in the practice of this invention. Enough energy must be supplied to the braze environment so that the braze will melt. Typically, this means raising the temperature of the braze to a temperature above its melting point, preferably about 1300° F. to about 1500° F. With resistance heat, typically about 0.2 volt to about 12 volts at about 5 amps to about 500 amps is applied across the wire, for a total wattage of, for example, about 100 watts. This current is applied for about 0.5 second to about 2 seconds, however this can vary according to the wire size.

To accomplish brazing, it is possible to place a small quantity of braze in a space left between the two wire segments, although it is difficult to select the proper size braze piece. Thus, it is preferred to push two flat surfaced butt ends of the wire segments together with a light pressure, and as resistance heat is applied to the wire, touch solder to the joint. It is especially preferred to dip the braze into the flux and apply the coated braze to the joint. Before the braze melts, the flux will flow over the joint coating the joint at the lower temperature. The brazing process may leave residual braze on the surface of the wire which causes problems during coating if not removed. The wire surface can be easily made uniform by a light sanding and/or the use of a swaging tool such as the Micro-Swage available from M.G.S. Mfg., Inc., Rome, N.Y.

A clearer understanding of the brazing process may be had by reference to the drawings. In FIG. 1, an exemplary brazing procedure is depicted. Two wire substrate segments are joined at their butt ends 101. A current 102 is directed across the wire segments in order to resistance heat them. Solder 103 coated with flux 104 is touched to the joint 101.

In FIG. 2, an enlarged portion of the brazed joint 101, partly broken away and partly in section, is depicted. It illustrates that although the wires touch, there is space left in the joint 101 for braze 103.

A commercially available brazing apparatus that works well in the practice of this invention is a microweld model BU-1 brazing unit available from Micro Products Company, 20 North Wacker Drive, Chicago, Ill. The above described brazing technique is critical in the practice of this invention as, for example, a cold weld or hot welding procedure causes hangups and stoppages as the wire passes through the enameling die.

For instance, in the cold welding process, there are several deformations of the wire shape which occur. The first is that in a typical cold welding process, the ends of the wire are flattened and joined together forming a flange. The excess portion of the flange may be cut off and sanded down so that it conforms with the wire but this still leaves abraded sections. In addition, in order to work the wire, it is necessary to grip the wire, typically along a two inch section on either side of the joint. This gripping action deforms the wire to an oval shape along the above identified wire section. In addition, because the wire has been worked resulting in a harder material, the copper in the area of a cold weld is much harder to sand and conform to the circumference of the wire. This results in even greater deformations as it is gripped and sanded. Because this coating process uses higher solids coatings, any wire deformations cause significant problems.

In high solids coatings, there is less solvent which can evaporate from the coating, so as the coated wire is cured more solids remain on the wire. To compensate for the greater solids that remain on the wire, a smaller circumference die must be used to obtain the same coating thickness as with lower solids processes. The close tolerance of the die results in hangups if there are any perturbations on the wire. For instance, the oval shapes formed by gripping the wire can cause hangups at the die. Because of the oval shape of the wire, part of the surface will have a thicker enamel coating and as the solvent evaporates through the thicker coating, blisters and beads occur on the coating. When the wire passes through another coating operation, the blisters and beads cause the wire to hang up at the die.

On the other side of this spectrum, a hot weld results in similar difficulties. The flash or perturbations caused by hot welding must be cut down and/or sanded. This results in the same type of wire deformations and resultant wire hangups at the enameling die.

The present invention relies on a controlled heating of the wire prior to entering the coating die to produce a wire with suitable magnet wire properties while allowing a much greater rate of speed in the coating operation. The wire is heated to an elevated temperature, preferably above 150° F., for example, by utilizing the heat from the curing oven, i.e. a chamber adjacent to the curing oven held at a temperature of about 300° F. to about 350° F. Next, the wire is coated using the above-described high solids enamel coating. It is run through a typical wire centering die at high speed, preferably at a speed constant of at least 5000. The speed constant is defined as the wire diameter and mils multiplied by the speed the wire is run through the die and feet per minute. Typically, multiple passes are made through the coating bath and wire centering die. As described above, the multiple passes result in wire hangups at the wire centering die when a previous curing process resulted in bumps, boils, blisters and other perturbations. Finally, the enamel coated magnet wire is cured, preferably by passing it through a curing oven at temperatures from about 700° F. to about 1100° F.

EXAMPLE

The ends of two 18 AWG copper wires were cut square and inserted into the clamping jaws of a microweld BU-1 brazing unit. At this point, the wires were lined up end to end and secured with a clamping mechanism. Once aligned, a very light pressure was applied by means of a cam action which lightly pushed the wire ends together. The Sil-Fos silver solder wire 24 AWG 0.02 inch was dipped into a reservoir of Handy Flux and the resulting "flux coated silver solder wire" was manually held onto the junction of the two copper wires. Power was applied to the clamping jaws holding the contacted wire. A current equal to 250 amps at 0.4 volt flowed through the wire for about 0.75 second from one jaw to the other to heat the wire. When the wire approached the melt point of the Sil-Fos wire (1184° F.) a melted bead of solder formed and then flowed into the crevice formed by the butted wire ends as the temperature approached the 1301° F. flow point of the Sil-Fos. As the material flowed the power was released and the wires cooled to form a solid joint.

The above process resulted in a joint strength greater that 27,000 p.s.i. The cooled "joint area" was formed with a micro-swage hand tool to a diameter equal to the wire size involved. Prior to enamelling, only very light sanding with 400 grit paper was required on the round joint to fully remove any very slight burrs that were present.

These brazed joints have a tensile strength greater than 27,000 p.s.i.; which is a sufficient strength to withstand coating processes used in the applications for which magnet wire has its most popular uses. Although the strength of the bond may not be as strong as a cold weld, the cold weld is more likely to result in wire hangups at the enameling die as described earlier. However, the brazed joints of this invention are of greater tensile strength than a hot weld because the hot welds require such elevated temperatures that surface chemical oxidation occurs at such a fast rate that the weld strength can be diminished. In addition, as was true with the cold weld, the hot weld was not capable of being conformed to the circumference of the wire without substantially altering the surface integrity of the wire resulting in hangups at the wire centering die.

This invention provides a method of coating continuous wires with a high solids enamel for magnet wire applications. The process enables the continuity of production eliminating wire hangups and stoppages at the enamel coating die. Thus this discovery makes a significant advance in the art of high speed wire coating processes.

Although this invention has been shown and described with respect to detail embodiments thereof, it will be understood by those skilled in the art that various changes in form and detail thereof may be made without departing from the spirit and scope of the claimed invention.

We claim:

1. A method of applying magnet wire enamel to continuous lengths of electrically conducting copper or copper alloy wire substrate comprising joining a plurality of wire substrate segments to form a continuous length of wire substrate having at least one joint, preheating and controlling the temperature of the wire substrate to an elevated temperature prior to application of the enamel utilizing as the enamel a nonrecirculating polymer composition having a high solids content and a high viscosity, applying the enamel through a wire-centering coating die at a high speed, and curing the enamel, wherein the improvement comprises:

joining the wire segments by brazing an end of one wire substrate segment to an end of a second wire substrate segment utilizing a braze whose melting point is greater than 1000° F. and less than 1600° F. resulting in a joint that has a tensile strength greater than 27,000 pounds per square inch, and is capable of being conformed to the circumference of the wire substrate segments without substantially altering the surface integrity of the wire.

* * * * *